US009017112B1

(12) United States Patent
Knowles et al.

(10) Patent No.: US 9,017,112 B1
(45) Date of Patent: Apr. 28, 2015

(54) ELECTRICAL WIRE NUT WITH DETACHABLE BREAK-OFF CONNECTORS

(71) Applicants: Keith Knowles, Villa Rica, GA (US); Kraig Knowles, Villa Rica, GA (US)

(72) Inventors: Keith Knowles, Villa Rica, GA (US); Kraig Knowles, Villa Rica, GA (US)

( * ) Notice: Subject to any disclaimer, the term of this patent is extended or adjusted under 35 U.S.C. 154(b) by 0 days.

(21) Appl. No.: 14/177,294

(22) Filed: Feb. 11, 2014

(51) Int. Cl.
*H01R 4/00* (2006.01)
*H01R 4/12* (2006.01)
*H01R 4/22* (2006.01)

(52) U.S. Cl.
CPC ... *H01R 4/12* (2013.01); *H01R 4/22* (2013.01)

(58) Field of Classification Search
CPC ..... H01R 4/22
USPC ..... 174/87; 439/784, 805
See application file for complete search history.

(56) References Cited

U.S. PATENT DOCUMENTS 3,165,576 A * 1/1965 Lige ..... 174/87
3,717,839 A * 2/1973 Aldridge ..... 439/431
4,606,592 A * 8/1986 Neff ..... 439/712
D315,143 S * 3/1991 Blaha ..... D13/150
5,252,779 A * 10/1993 DiRienzo ..... 174/87
5,531,618 A * 7/1996 Market ..... 439/840
5,791,919 A * 8/1998 Brisson et al. ..... 439/891
5,828,004 A * 10/1998 Nazco et al. ..... 174/87
5,925,853 A * 7/1999 Miller ..... 174/87
5,939,678 A * 8/1999 Boyanich et al. ..... 174/87
5,975,939 A * 11/1999 Market ..... 174/87
6,341,979 B1 * 1/2002 Yamamoto ..... 439/415

FOREIGN PATENT DOCUMENTS

EP 1028487 8/2000
WO WO9317467 9/1993

* cited by examiner

*Primary Examiner* — Briggitte R Hammond
(74) *Attorney, Agent, or Firm* — Kyle A. Fletcher, Esq

(57) ABSTRACT

The electrical wire nut with detachable break-off connectors includes a wire nut that includes a removable cap that separates from a distal end of the wire nut. The removable cap is removed to expose a plurality of different connectors that are in electrical connection with a threaded member located inside of the wire nut. The plurality of different connectors is individually removed to leave a selected connector in tact with respect to the threaded member. The electrical wire nut is configured to work with at least one electrical wire in order to provide an electrical connector that is in turn adapted for use with an electrical connector receptacle.

20 Claims, 4 Drawing Sheets

ELECTRICAL WIRE NUT WITH DETACHABLE BREAK-OFF CONNECTORS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of electrical connectors and fasteners, more specifically, an electrical wire nut that includes a plurality of different connectors that are selectively retained for use.

SUMMARY OF THE INVENTION

The electrical wire nut with detachable break-off connectors includes a wire nut that includes a removable cap that separates from a distal end of the wire nut. The removable cap is removed to expose a plurality of different connectors that are in electrical connection with a threaded member located inside of the wire nut. The plurality of different connectors is individually removed to leave a selected connector in tact with respect to the threaded member. The electrical wire nut is configured to work with at least one electrical wire in order to with an electrical connector receptacle. It shall be noted that the electrical wire nut may be also configured to use with multiple electrical wires in order to secure said multiple electrical wires together as well as to adaptively provide an electrical connector with an electrical connector receptacle.

It is an object of the invention to provide an electrical wire nut that is useful in securing one or more wires together.

A further object of the invention is to provide a wire nut that includes a plurality of break-off connectors that are selectively removed to leave one connector remaining, which will be configured to secure said electrical wire nut to an electrical connector receptacle.

These together with additional objects, features and advantages of the electrical wire nut with detachable break-off connectors will be readily apparent to those of ordinary skill in the art upon reading the following detailed description of presently preferred, but nonetheless illustrative, embodiments of the electrical wire nut with detachable break-off connectors when taken in conjunction with the accompanying drawings.

In this respect, before explaining the current embodiments of the electrical wire nut with detachable break-off connectors in detail, it is to be understood that the electrical wire nut with detachable break-off connectors is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the electrical wire nut with detachable break-off connectors.

It is therefore important that the claims be regarded as including such equivalent construction insofar as they do not depart from the spirit and scope of the electrical wire nut with detachable break-off connectors. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 2:
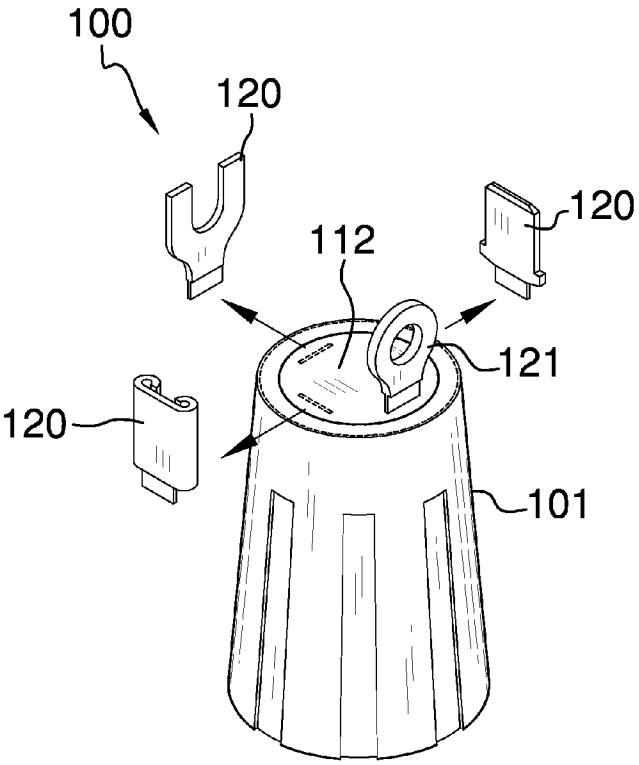
FIG. 2 illustrates another perspective view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to the preferred embodiment of the present invention, examples of which are illustrated in FIGS. 1-7. An electrical wire nut with detachable break-off connectors 100 (hereinafter invention) is further defined with a housing member 101 that is generally defined as being concave in shape, and including a bottom opening 102 that provides access to a wire nut member 110 included within the housing member 101. The wire nut member 110 is also generally concave in shape, and includes internal threading, which is ideal for securement of one or more wire ends 300 therein. It shall be noted that the invention 100 is configured for use with one or more wire ends 300, and that the wire nut member 110 engages to and secure the one or more wire ends 300 to the invention 100.

The wire nut member 110 includes a connector plate 112 that is provided at a top distal end 104 of the housing member

101. The connector plate 112 features an array of different break-off connectors 120 thereon. The break-off connectors 120 are different from one another, and are selectively removed from the invention 100 upon rotating the selected break-off connector back and forth with respect to the connector plate 112. The break-off connectors 120 are commonly known in the art of electrical connectors, and usually include a crimping member for securement of a wire end. It shall be noted that the invention 100 requires removing all but one of the break-off connectors 120 from the connector plate 112, which leaves a selected break-off connector 121 remaining. The selected break-off connector 121 is configured for attachment with an electrical connector receptacle 200.

Figure 1:
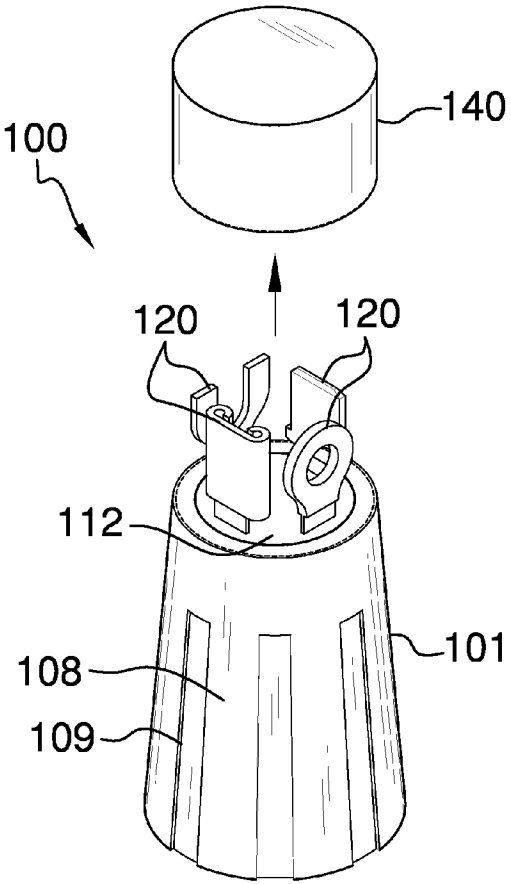
FIG. 1 illustrates a perspective view of an embodiment of the disclosure.
Figure 5:
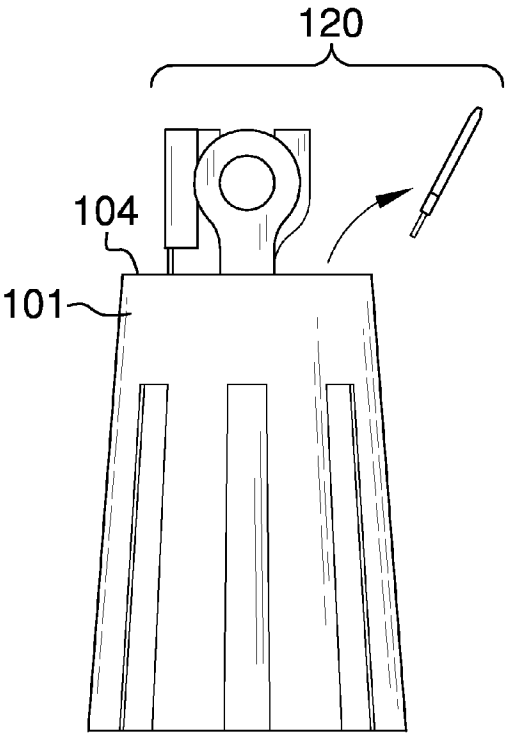
FIG. 5 illustrates a side view of an embodiment of the disclosure.
Figure 4:
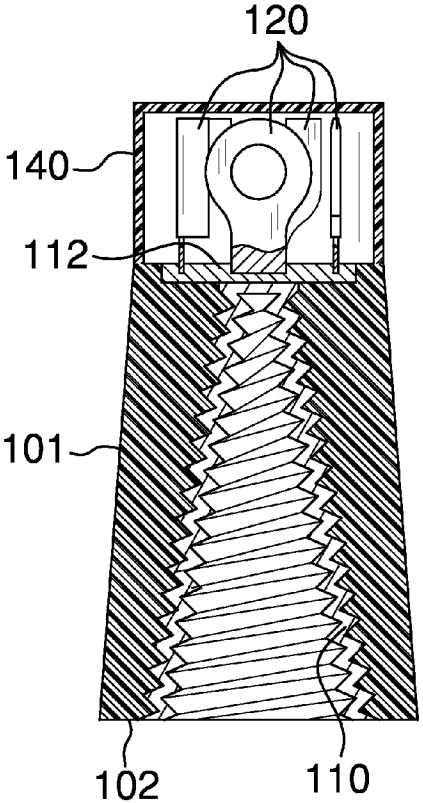
FIG. 4 illustrates a cross-sectional view along line 4-4 in FIG. 3.
Figure 3:
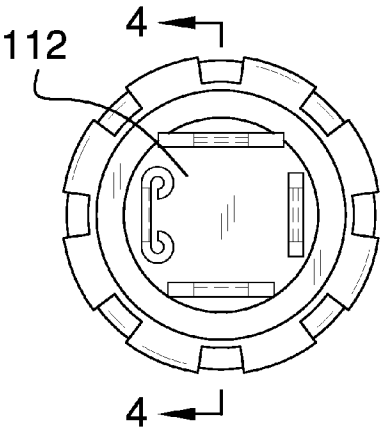
FIG. 3 illustrates a top view of an embodiment of the disclosure.
Figure 6:
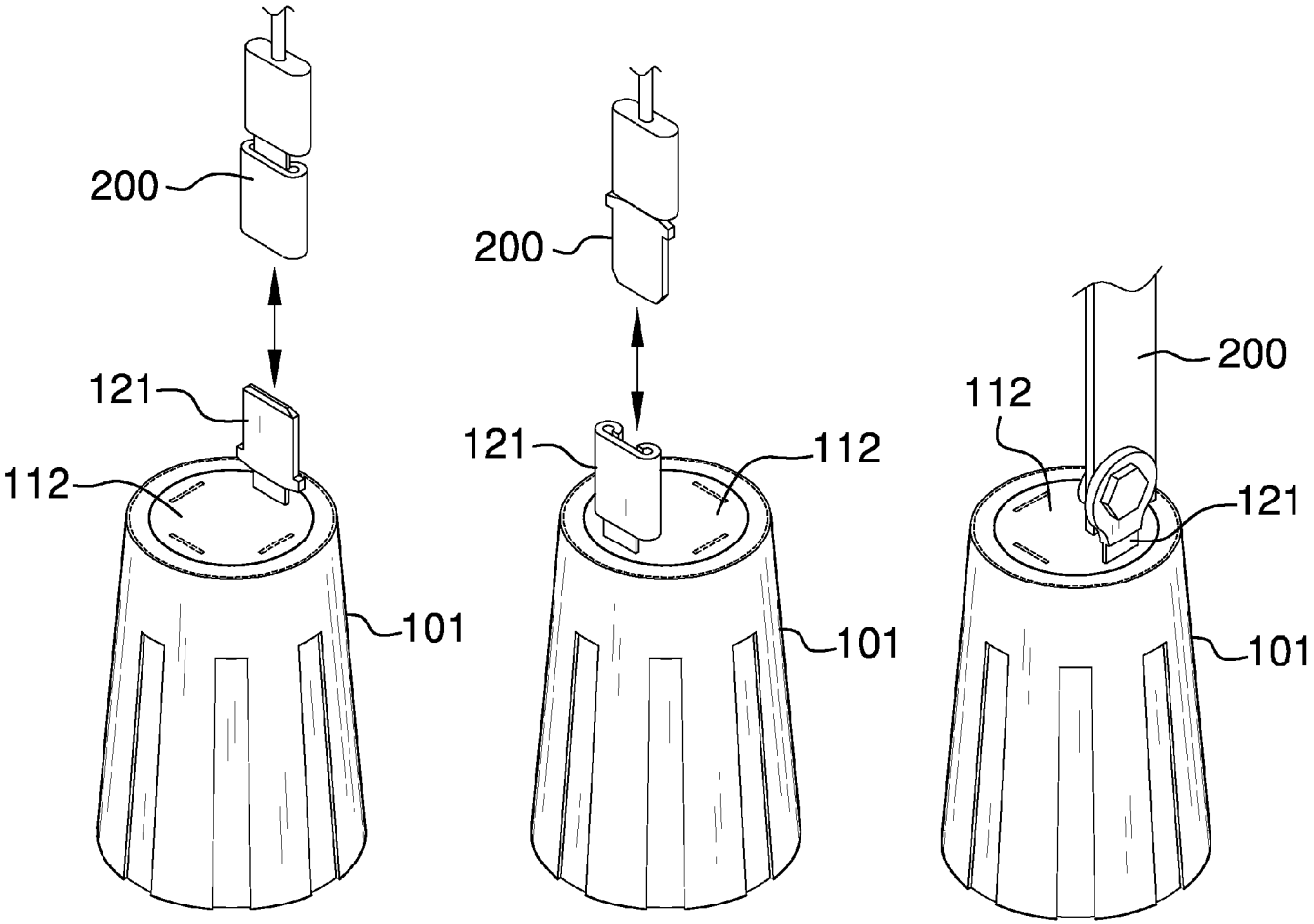
FIG. 6 illustrates an embodiment of the disclosure in use with other electrical connector receptacles.

Referring to FIG. 1, the housing member 101 includes a removable cap 140 that is removed prior to use with the break-off connectors 120. The removable cap 140 is attached to the top distal end 104 of the housing member 101. The removable cap 140 is constructed of the same material as the housing member 101, which shall be a non-conductive material, which shall insulate against electrically conductive materials. The removable cap 140 is a cup-shaped object that is open on one end such that the removable cap 140 encloses the connector plate 112 and the break-off connectors 120 prior to use.

Figure 7:
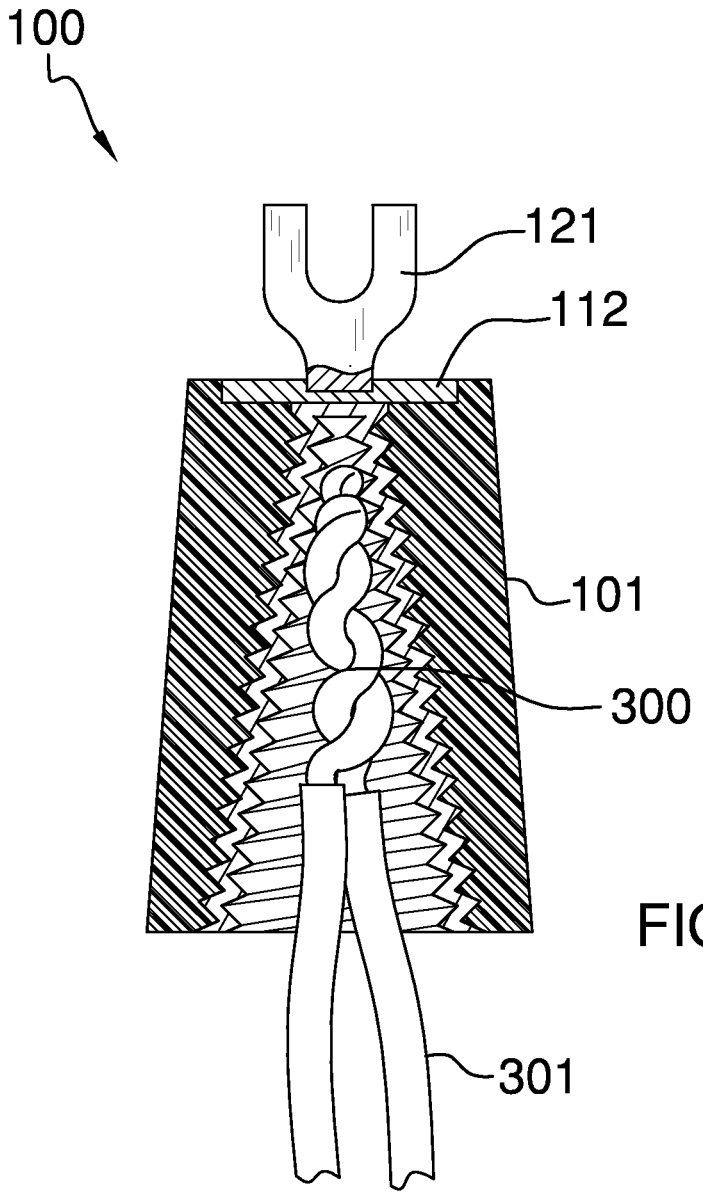
FIG. 7 is another cross-sectional view of an embodiment of the disclosure.

Referring to FIG. 7, the invention 100 is configured for use with at least one wire end 300. Moreover, the bottom opening 102 of the housing member 101 enables multiple wires 301 to be threadably secured to the wire nut member 110 seated inside of the housing member 101. Moreover, the wire nut member 110 and the connector plate 112 are in electrical connection with the break-off connectors 120.

The housing member 101 is further defined with an exterior surface 108, which includes grooves 109 integrated thereon. The grooves 109 are longitudinally oriented in order to provide enhanced gripping action when rotating the housing member 101 and the wire nut member 110 onto the wire ends 300. It shall also be noted that the break-off connectors 120 are generally parallel with one another. The break-off connectors 120 are perpendicularly-oriented with respect to both the connector plate 112 as well as the top distal end 104.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. An electrical wire nut with detachable break-off connectors comprising:

a housing member that includes a wire nut member therein;

wherein the wire nut member is configured to secure to at least one wire end;

wherein the wire nut member includes a connector plate from which a plurality of break-off connectors are provided;

wherein all but one of the break-off connectors are removed from the connector plate in order to leave a selected break-off connector;

wherein the selected break-off connector is configured for use with an electrical connector receptacle.

2. The electrical wire nut with detachable break-off connectors as described in claim 1 wherein the housing member is generally concave in shape, and includes a bottom opening that provides access to the wire nut member included within the housing member; wherein the wire nut member is also generally concave in shape, and includes internal threading, which is ideal for securement of the at least one wire end therein.

3. The electrical wire nut with detachable break-off connectors as described in claim 2 wherein the connector plate is provided at a top distal end of the housing member; wherein the connector plate features the break-off connectors thereon; wherein the break-off connectors are different from one another; wherein the break-off connectors are selectively removed from the connector plate upon rotating the break-off connector back and forth with respect to the connector plate.

4. The electrical wire nut with detachable break-off connectors as described in claim 3 wherein the housing member includes a removable cap that is removed prior to use with the break-off connectors.

5. The electrical wire nut with detachable break-off connectors as described in claim 4 wherein the removable cap is attached to the top distal end of the housing member.

6. The electrical wire nut with detachable break-off connectors as described in claim 5 wherein the removable cap is a cup-shaped object that is open on one end such that the removable cap encloses the connector plate and the break-off connectors prior to use.

7. The electrical wire nut with detachable break-off connectors as described in claim 6 wherein the bottom opening of the housing member enables multiple wires that each include a wire end to be threadably secured to the wire nut member seated inside of the housing member.

8. The electrical wire nut with detachable break-off connectors as described in claim 7 wherein the wire nut member and the connector plate are in electrical connection with the break-off connectors.

9. The electrical wire nut with detachable break-off connectors as described in claim 8 wherein the housing member is further defined with an exterior surface, which includes grooves integrated thereon.

10. The electrical wire nut with detachable break-off connectors as described in claim 9 wherein the grooves are longitudinally oriented in order to provide enhanced gripping action when rotating the housing member and the wire nut member onto the at least one wire end.

11. The electrical wire nut with detachable break-off connectors as described in claim 10 wherein the break-off connectors are generally parallel with one another.

12. The electrical wire nut with detachable break-off connectors as described in claim 11 wherein the break-off connectors are perpendicularly-oriented with respect to both the connector plate as well as the top distal end.

13. An electrical wire nut with detachable break-off connectors comprising:

a housing member that includes a wire nut member therein;

wherein the wire nut member is configured to secure to at least one wire end;

wherein the wire nut member includes a connector plate from which a plurality of break-off connectors are provided;

wherein all but one of the break-off connectors are removed from the connector plate in order to leave a selected break-off connector;

wherein the selected break-off connector is configured for use with an electrical connector receptacle;

wherein the housing member is generally concave in shape, and includes a bottom opening that provides access to the wire nut member included within the housing member; wherein the wire nut member is also generally concave in shape, and includes internal threading, which is ideal for securement of the at least one wire end therein.

14. The electrical wire nut with detachable break-off connectors as described in claim 13 wherein the connector plate is provided at a top distal end of the housing member; wherein the connector plate features the break-off connectors thereon; wherein the break-off connectors are different from one another; wherein the break-off connectors are selectively removed from the connector plate upon rotating the break-off connector back and forth with respect to the connector plate.

15. The electrical wire nut with detachable break-off connectors as described in claim 14 wherein the housing member includes a removable cap that is removed prior to use with the break-off connectors.

16. The electrical wire nut with detachable break-off connectors as described in claim 15 wherein the removable cap is attached to the top distal end of the housing member; wherein the removable cap is a cup-shaped object that is open on one end such that the removable cap encloses the connector plate and the break-off connectors prior to use.

17. The electrical wire nut with detachable break-off connectors as described in claim 16 wherein the bottom opening of the housing member enables multiple wires that each include a wire end to be threadably secured to the wire nut member seated inside of the housing member.

18. The electrical wire nut with detachable break-off connectors as described in claim 17 wherein the wire nut member and the connector plate are in electrical connection with the break-off connectors.

19. The electrical wire nut with detachable break-off connectors as described in claim 18 wherein the housing member is further defined with an exterior surface, which includes grooves integrated thereon; wherein the grooves are longitudinally oriented in order to provide enhanced gripping action when rotating the housing member and the wire nut member onto the at least one wire end.

20. The electrical wire nut with detachable break-off connectors as described in claim 19 wherein the break-off connectors are generally parallel with one another; wherein the break-off connectors are perpendicularly-oriented with respect to both the connector plate as well as the top distal end.

* * * * *